US007631654B2

(12) United States Patent
Blumenthal et al.

(10) Patent No.: US 7,631,654 B2
(45) Date of Patent: Dec. 15, 2009

(54) UMBRELLA ATTACHMENT DEVICE

(75) Inventors: Emily Blumenthal, 50 E. 8th St., Apt. #4W, New York, NY (US) 10003; Aaron Barere, Hoboken, NJ (US)

(73) Assignee: Emily Blumenthal, New York, NY (US)

( * ) Notice: Subject to any disclaimer, the term of this patent is extended or adjusted under 35 U.S.C. 154(b) by 349 days.

(21) Appl. No.: 11/688,494

(22) Filed: Mar. 20, 2007

(65) Prior Publication Data

US 2008/0230102 A1 Sep. 25, 2008

(51) Int. Cl.
*A45B 11/00* (2006.01)

(52) U.S. Cl. ..... 135/16; 135/20.1; 280/642; 248/514; 248/460

(58) Field of Classification Search ..... 135/15.1, 135/16, 20.1, 20.3, 33.2, 905, 96, 98, 25.4; 297/184.1, 184.15, 184.16; 280/642, 47.4, 280/47.38; 248/514, 292.12, 534, 540, 541; 403/93, 94, 96

See application file for complete search history.

(56) References Cited

U.S. PATENT DOCUMENTS

| | | | | | |
|---|---|---|---|---|---|
| 229,685 | A | | 7/1880 | Ege | |
| 312,446 | A | | 2/1885 | Drake | |
| 336,363 | A | | 2/1886 | Ward | |
| 553,735 | A | | 1/1896 | Murgatroyd | |
| 635,612 | A | | 10/1899 | Tardel | |
| 690,342 | A | * | 12/1901 | Anderson | 135/88.04 |
| 1,031,974 | A | | 7/1912 | Thomas | |
| 1,723,044 | A | | 8/1929 | Khalil | |
| 2,948,289 | A | | 8/1960 | Owczarek | |
| 3,042,055 | A | | 7/1962 | Todorovic | |
| 3,304,035 | A | | 2/1967 | Davis | |
| 3,304,036 | A | * | 2/1967 | Davis | 248/514 |
| 3,419,295 | A | | 12/1968 | Small | |
| 3,848,838 | A | | 11/1974 | Thomas | |
| 4,871,141 | A | * | 10/1989 | Chen | 248/534 |
| 4,887,786 | A | | 12/1989 | Stokes | |
| 4,919,379 | A | | 4/1990 | Goetz | |
| 5,076,526 | A | * | 12/1991 | Zane et al. | 248/314 |
| 5,505,221 | A | | 4/1996 | Gao | |
| 5,518,218 | A | * | 5/1996 | Leonard | 248/530 |

(Continued)

FOREIGN PATENT DOCUMENTS

GB 2265410 A * 9/1993

(Continued)

*Primary Examiner*—Winnie Yip
(74) *Attorney, Agent, or Firm*—Banner & Witcoff, Ltd.

(57) ABSTRACT

A device for attaching an umbrella to a structure is described. The umbrella attachment device includes a device side member, an umbrella side member and a storage member. The storage member is directly attached to a structure and includes an inner compartment and an outer compartment. The storage member is arranged so that the inner compartment is proximal to the structure as compared to the outer compartment. The device allows for alternation between a storage position and a use position. The storage position includes the device side member being attached to the inner compartment and the umbrella side member being attached to the outer compartment. In the storage position, the device side member and the umbrella side member are positioned substantially parallel to one another. The use position is characterized by the device side member being attached to the inner compartment and also attached to the umbrella side member.

19 Claims, 9 Drawing Sheets

U.S. PATENT DOCUMENTS

| | | | | |
|---|---|---|---|---|
| 5,711,331 | A | 1/1998 | Harris | |
| 5,762,308 | A * | 6/1998 | Bryan | 248/314 |
| 5,873,624 | A * | 2/1999 | Simpson | 297/45 |
| D419,759 | S | 2/2000 | Goudarzi | |
| 6,032,917 | A * | 3/2000 | Shannon | 248/514 |
| 6,173,724 | B1 | 1/2001 | You | |
| D437,109 | S | 2/2001 | Muscella | |
| 6,244,557 | B1 | 6/2001 | Maze | |
| 6,357,710 | B1 | 3/2002 | Fielden et al. | |
| 6,390,427 | B1 | 5/2002 | McConnell et al. | |
| 6,634,609 | B2 * | 10/2003 | Zheng | 248/277.1 |
| D504,221 | S | 4/2005 | Protano | |
| 7,226,126 | B1 * | 6/2007 | Spanovich | 297/184.16 |
| 7,493,908 | B2 * | 2/2009 | Carter et al. | 135/16 |
| 2002/0157693 | A1 * | 10/2002 | Whitmer | 135/16 |
| 2003/0218105 | A1 | 11/2003 | Sones et al. | |
| 2004/0222678 | A1 * | 11/2004 | Hansen | 297/184.1 |
| 2006/0289044 | A1 * | 12/2006 | Benett | 135/16 |

FOREIGN PATENT DOCUMENTS

| | | | |
|---|---|---|---|
| GB | 2342858 | A * | 4/2000 |
| JP | 2000152864 | A * | 6/2000 |
| JP | 2001070129 | A * | 3/2001 |

* cited by examiner

UMBRELLA ATTACHMENT DEVICE

TECHNICAL FIELD

The present invention relates generally to a device for attaching an umbrella to a structure. More specifically, the invention provides a device including telescopic and pivoting members which may be removably attached to a structure, such as a stroller.

BACKGROUND

With the variability of weather systems one may never be able to accurately predict potential rain or extreme sun. Exposure to the sun and its harmful UV radiation can result in sunburn and potentially cancer. Exposure to rain often causes discomfort and aggravation because of wet clothes. It is therefore desirable to have protection from these elements while still enjoying the outdoor environment.

Conventional umbrellas can be used for protection from the outdoors but they are commonly bulky, uncomfortable and easy to forget. If a mother, for example, wished to take a walk with her child in a stroller, she could carry an umbrella in preparation for inclement weather. However, this becomes quite difficult since two hands are normally required to push a stroller. The question becomes where to put the umbrella. It is also easy to forget an umbrella, placing one in the unfortunate position of being outdoors with no sun or rain protection.

SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

According to aspects of the invention, an umbrella attachment device allows a user to attach an umbrella to a structure, such as a stroller. The umbrella attachment device of the invention allows for convenient switching between a storage position and a use position. The storage position includes a closed umbrella positioned in a compact location adjacent to the stroller. The use position includes an extended and open umbrella that is ready for use.

The umbrella attachment device includes a device side member, an umbrella side member, and a storage member which is directly attached to a structure, such as a stroller. The storage member includes an inner compartment and an outer compartment, wherein the storage member is arranged so that the inner compartment is proximal to the structure as compared to the outer compartment. The device allows for alternation between a storage position and a use position. The storage position is characterized by the device side member being disconnected from the umbrella side member. The device side member is attached to the inner compartment of the storage member and the umbrella side member is attached to the outer compartment of the storage member. In this position, the umbrella side member and the device side member are stored substantially parallel to one another within the inner and outer compartments of the storage member. The use position is characterized by the device side member being connected to the umbrella side member. In this position the device side member is attached to the inner compartment of the storage member and the outer compartment of the storage member is empty. This position allows the umbrella to be open and also to be pivoted and telescopic.

Another aspect of the invention includes an umbrella side member which includes a first sub-member and a second sub-member. The first and second sub-members are connected by a pivot joint which is configured to change a degree of pivot of the first sub-member with respect to the second sub-member to one of at least three positions. The first and second sub-members of the umbrella side member also include first and second telescopic mechanisms, respectively. An umbrella is attached to the umbrella end of the second sub-member. It is advantageous to have an umbrella attached to a structure, such as a stroller, so that it is easily within reach. It is also beneficial to have the umbrella collapse into a position on or within the structure so that it is compact and out of the way.

DESCRIPTION OF THE DRAWINGS

The foregoing summary, as well as the following detailed description of illustrative embodiments, is better understood when read in conjunction with the accompanying drawings, which are included by way of example, and not by way of limitation with regard to the claimed invention.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
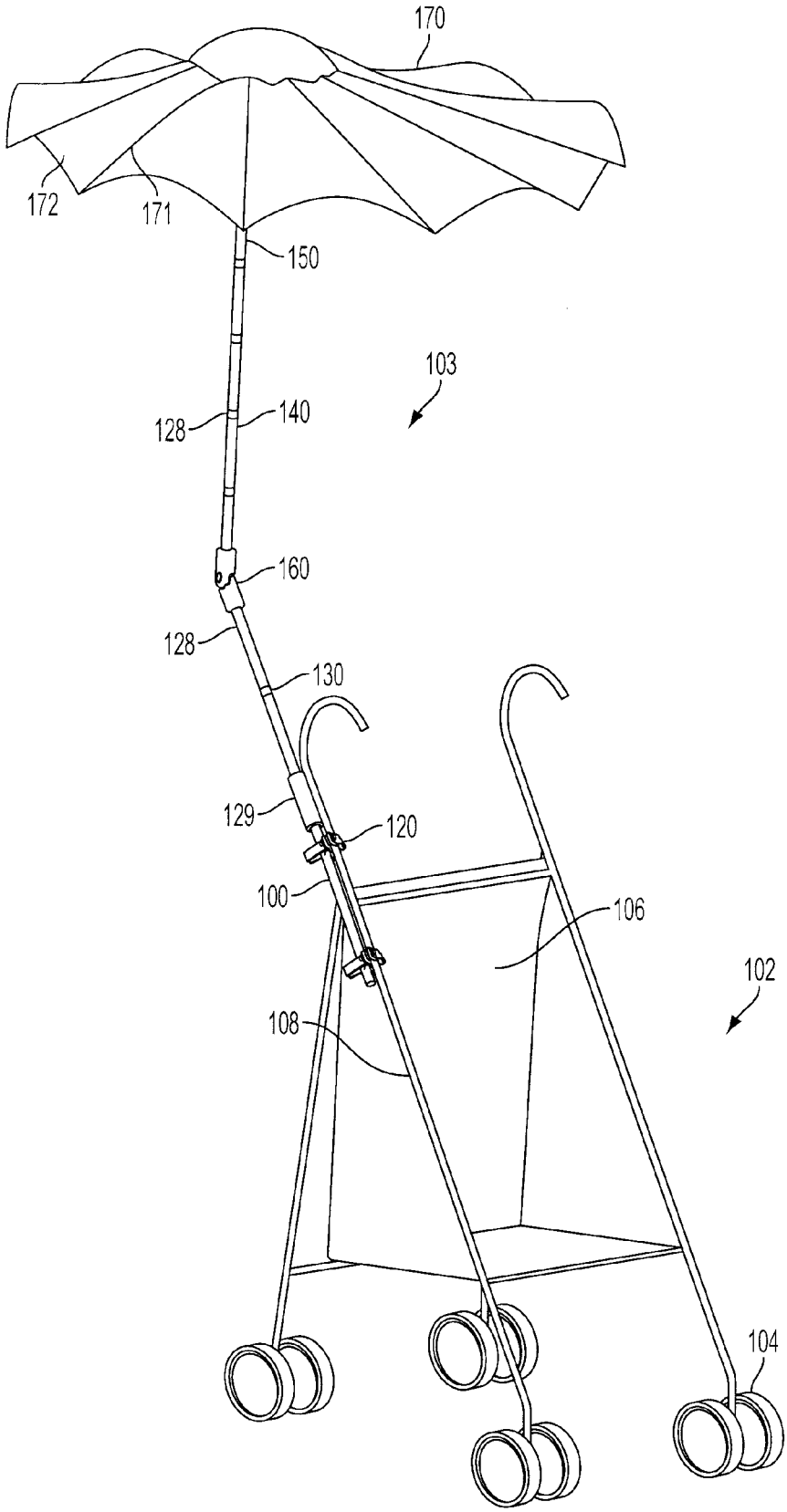
FIG. 1 is an illustrative view of an umbrella attachment device in a use position in accordance with at least one aspect of the present invention.

The umbrella attachment device 103 provides a user with the ability to conveniently attach an umbrella to a structure. In one example, the structure may be a child's stroller 102 which would typically have wheels 104, a seat 106 and arms 108. A structure may alternatively be things such as a golf bag or a food cart. For simplification of description purposes only, the following will describe the structure as a stroller 102. FIG. 1 shows the umbrella attachment device 103 of the present invention shown in the use position. An umbrella 170 is attached at the end of the umbrella side member 128 to provide shade or other protection from the outdoors. A device side member 100 connects the umbrella side member 128 to a storage member 120, which is directly attached to the stroller 102. The use position, as shown in FIG. 1, allows a user to enjoy the shade and outdoor protection of the umbrella. When the device is in the use position, a pivoting mechanism and a telescopic mechanism allow the user to adjust the positioning of the umbrella 170 for ultimate convenience and functionality. The umbrella can easily be pivotally positioned to various degrees (See FIG. 4D) and its positional height may also be longitudinally adjusted via telescopic mechanisms (See FIG. 3C). When the umbrella is no longer needed, the device may be configured to an alternate position that is referred to as the storage position (See FIG. 5A). In the storage position, the umbrella side member 128 and the closed umbrella 170 are stored in a substantially parallel orientation with respect to the arm 108 of a child's stroller 102.

Figure 2:
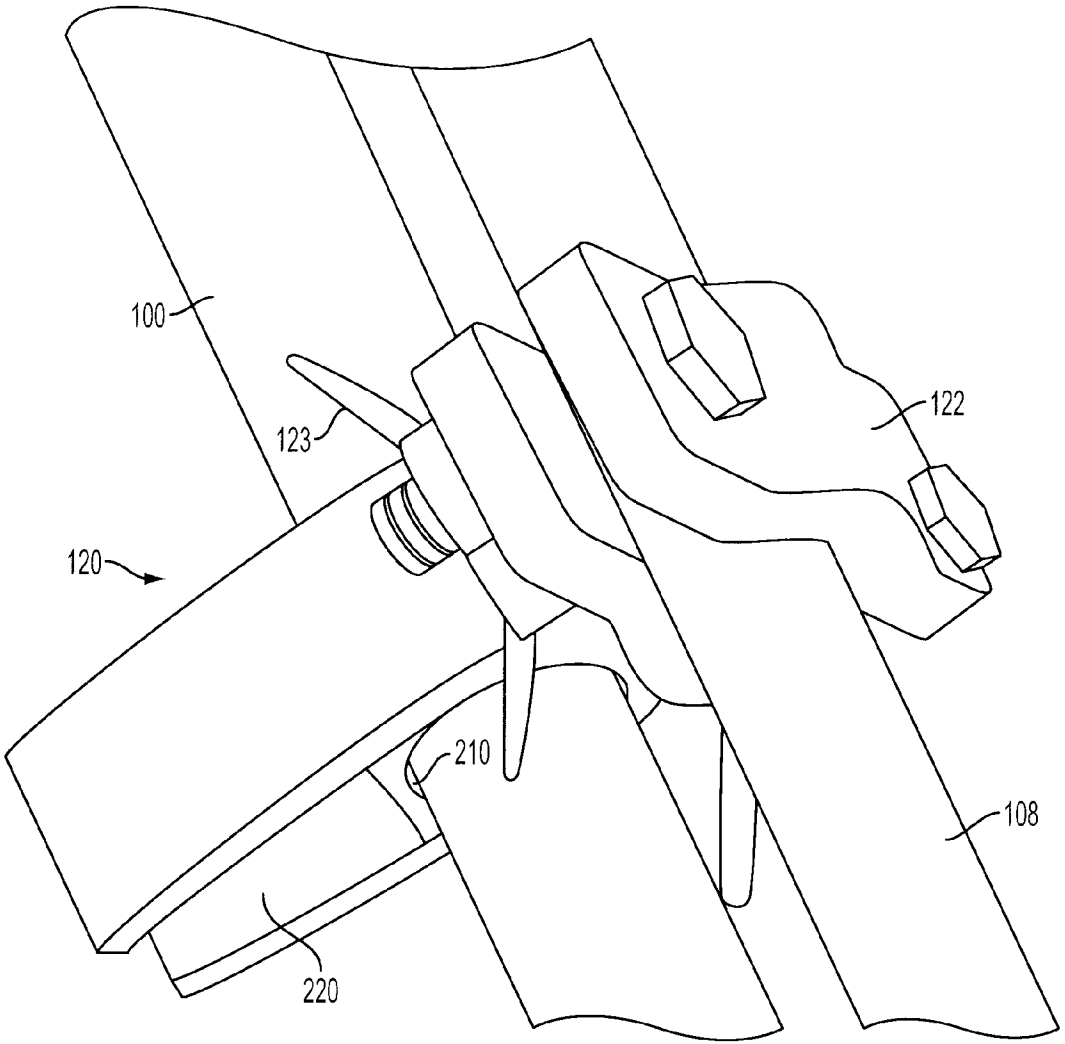
FIG. 2 is an illustrative view of a storage member of an umbrella attachment device.

FIG. 1 further shows that the device side member 100, which contains a base end 101 and a socket end 181, is attachable to an arm 108 of a stroller 102, via a storage member 120. The storage member 120 is shown in more detail in FIG. 2 and may be directly attached to the stroller 102 via a clamping mechanism 122. The clamping mechanism 122 can be tightened by a conventional hardware arrangement. In one example, wing nuts 123 and bolts may be advantageous so that no supplemental tools are required for attachment of the storage member 120 to the stroller 102.

The storage member 120 includes an inner compartment 210 and an outer compartment 220. The inner compartment 210 is proximal to the stroller 102 as compared to the outer compartment 220, which is distal to the stroller 102. Once the storage member 120 is attached to the stroller 102, the device side member 100 may be axially slid into the inner compartment 210 for a friction fit attachment arrangement. The inner compartment 210 includes a circular opening, or hole, to allow the device side member 100 to be received. In an alternative example, the device side member 100 may be permanently attached to, or even be integrally formed with the storage member 120. The storage member 120 also includes a generally "U shaped" outer compartment 220 into which the umbrella side member 128 may be inserted in a direction generally perpendicular to its axis to place into the storage position. In the illustrated embodiment, two storage members 120 are used for attachment of the umbrella side member 128 to the stroller 102. In other examples, not depicted, one, three, four or more storage members 120 may be utilized.

Figure 5A:
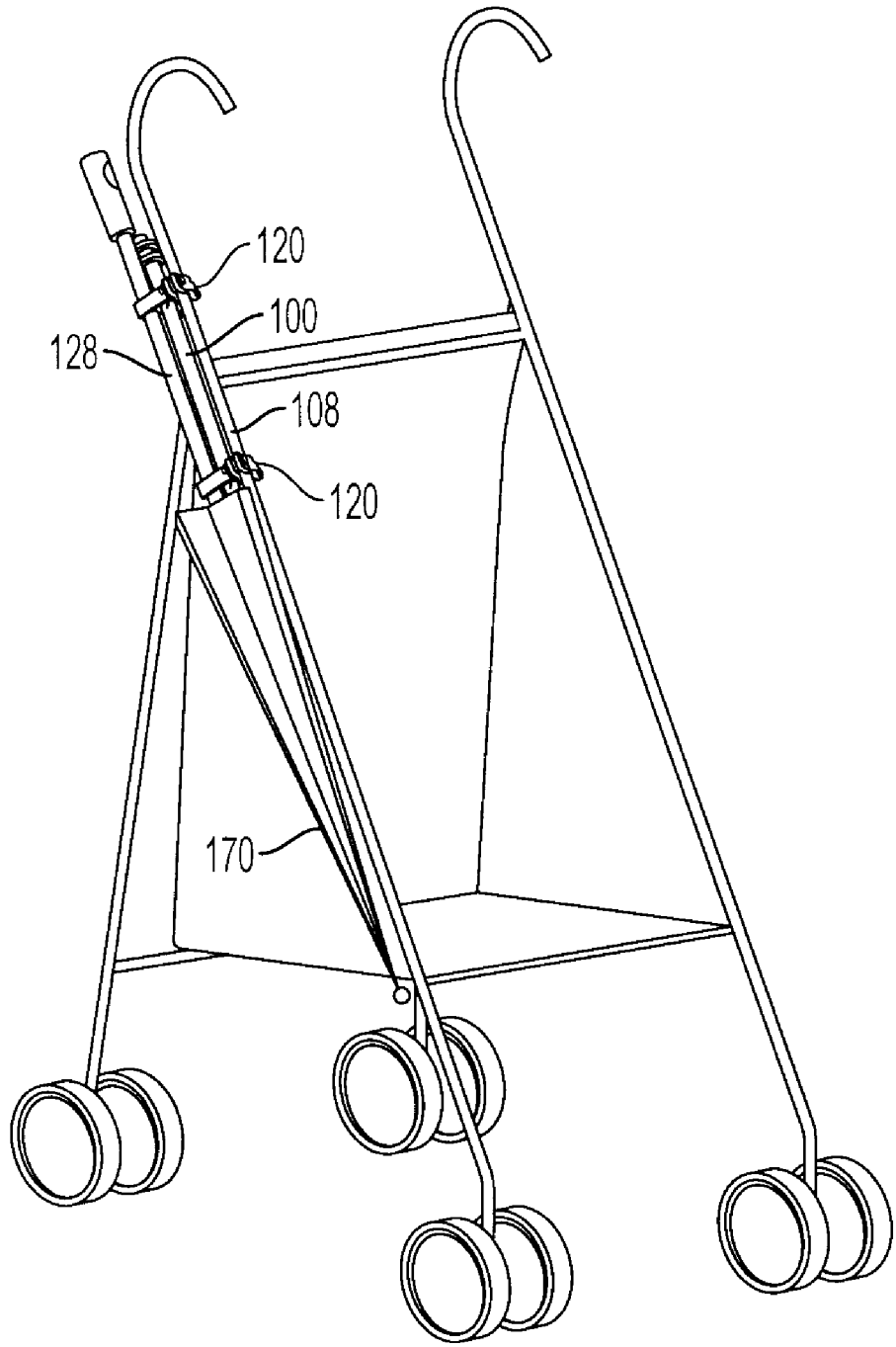
FIG. 5A is an illustrative view of an umbrella attachment device in a storage position.
Figure 5B:
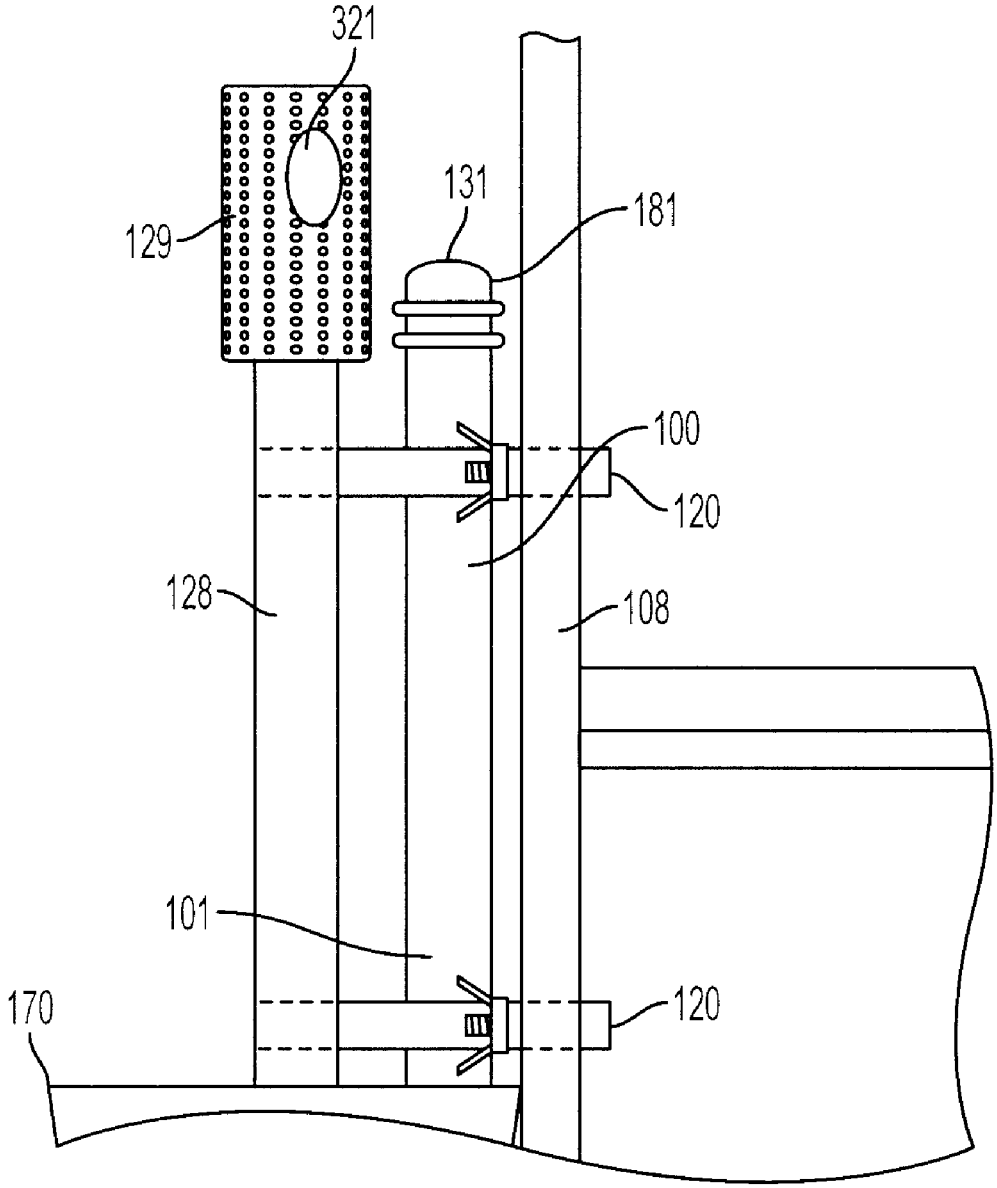
FIG. 5B is a more detailed illustrative view of an umbrella attachment device in a storage position.

Returning to FIG. 1, the umbrella side member 128 of the umbrella attachment device includes a first sub-member 130 and a second sub-member 140. The first sub-member 130 is on the end adjacent to the device side member 100 and the second sub-member 140 is on the side where the umbrella 170 is attached. The umbrella side member 128 is attachable to the device side member 100 to be placed in the use position so the umbrella can be extended and open as shown in FIG. 1. In one example, the umbrella side member 128 is attachable to the device side member 100 by a removable coupling 129. The removable coupling 129 is preferably fixedly attached to the umbrella side member 128 or the device side member 100. The end of the other of the umbrella side member 128 or the device side member 100 has an interfacing structure 131 enabling the selective locking and unlocking to the removable coupling 129. In one arrangement, as shown in FIG. 5B, the removable coupling 129 is attached to the umbrella side member 128 and the interfacing structure 131 is located on the device side member 100. Hereinafter, the interfacing structure 131 is referred to as the socket end 181 of the device side member 100. The locking arrangement afforded by the removable coupling 129 and the socket end 181, when locked, prevents unintended removal and rotation of the umbrella side member 128 with respect to the device side member 100. Any desirable coupling arrangement may be used. In one arrangement the locking arrangement may include steel balls. The steel balls are forced to a position to create an interference by a collar. When the collar is at its engaged position, it causes the balls to interfere with the cavity of the socket. When the collar is moved along the central axis of the fitting, the balls are free to fall into a position within the fitting such that they do not interfere with the cavity of the socket. FIG. 5B shows that a button 321 may be implemented which would simplify the use of a movable collar. Pushing the button causes the collar to move axially by means of mechanical leverage. Generally, this type of socket is referred to as a Sleeve-Lock Socket. In another example this may include a pneumatic or hydraulic fitting.

In accordance with at least one aspect of the present invention, a telescopic mechanism within the first sub-member 130 and/or the second sub-member 140 of the umbrella side member 128 may be used. Such a mechanism allows for multiple positioning in the direction of the arrow 333. This can enable compact storage when retracted and for variable height extension when extended and open. FIG. 3C shows, for example, telescopic positions 1 (340), 2 (342), and 3 (344). Each telescopic position places the umbrella at a different height. Telescopic mechanisms that may be used to extend and retract the umbrella side member 128 are well known within the art. In one example, telescopic mechanisms may include a member being composed of adjacent generally cone shaped entities which collapse into one another.

Figure 3A:
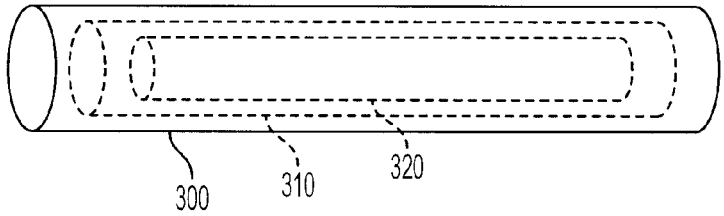
FIG. 3A is an illustrative view of a telescopic mechanism in a collapsed position.
Figure 3B:
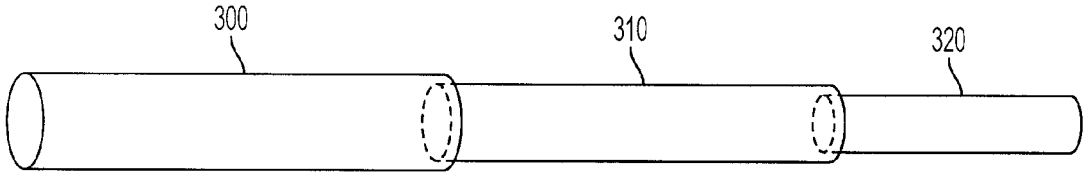
FIG. 3B is an illustrative view of a telescopic mechanism in an extended position.
Figure 3C:
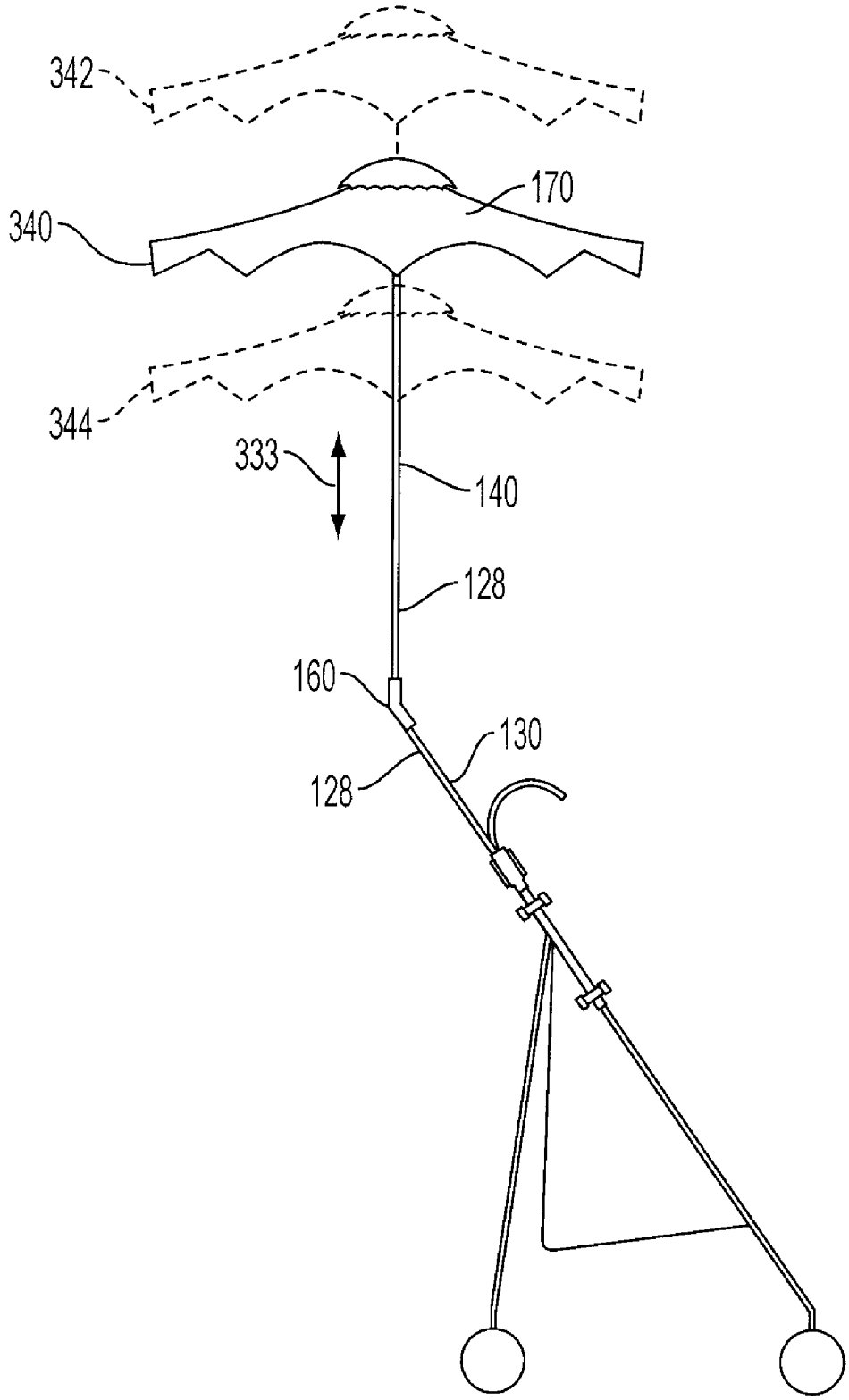
FIG. 3C is an illustrative view of an umbrella attachment device in a use position displaying various telescopic positions.

Such an example is illustrated with respect to FIGS. 3A and 3B. Each cone could, for example, be extended to allow for the appropriate height and twisted to lock into place. FIG. 3B shows telescopic cone 1 (300), 2 (310), and 3 (320) in an extended configuration. In this example, the telescopic mechanism includes three telescopic cones. In other examples, the telescopic mechanism may include two, three, four, five, ten, or more telescopic cones. The cones may be rotated and inwardly pushed allowing the member to collapse. Individual cones may vary in size so that they fit neatly within one another when collapsed as shown in FIG. 3A. FIG. 3A shows telescopic cones 1 (300), 2 (310), and 3 (320) in a collapsed configuration. In one example, a telescopic mechanism may include a spring loaded mechanism, not shown, wherein a spring causes a member to extend to its full length. Collapsing the member would then occur by compressing the member to its collapsed state. The spring loaded mechanism may be mechanical, electrical or both. In another example, a telescopic mechanism allows the members to collapse from approximately three feet to approximately one foot and to extend from approximately one foot to approximately three feet. If desired, a locking mechanism may be used to prevent unintended collapse of the telescopic mechanism.

Figure 4A:
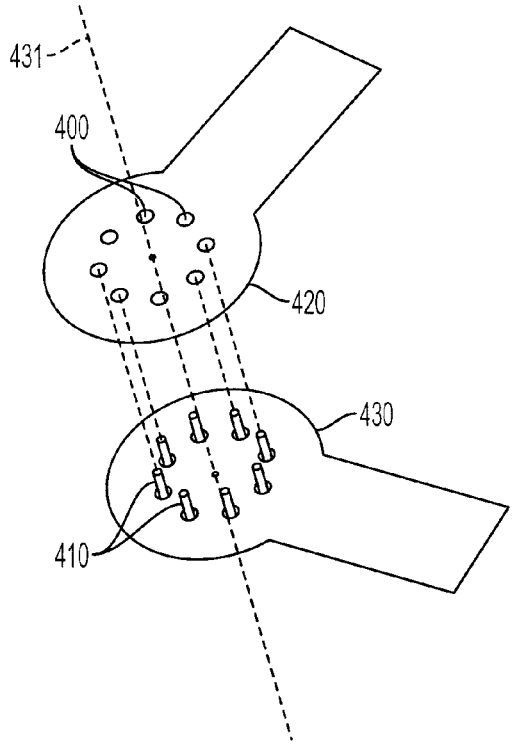
FIG. 4A is an illustrative view of a pivot joint.
Figure 4B:
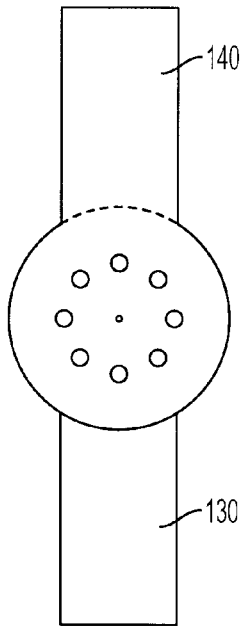
FIG. 4B is an illustrative view of one example of a pivot joint in the storage position.
Figure 4C:
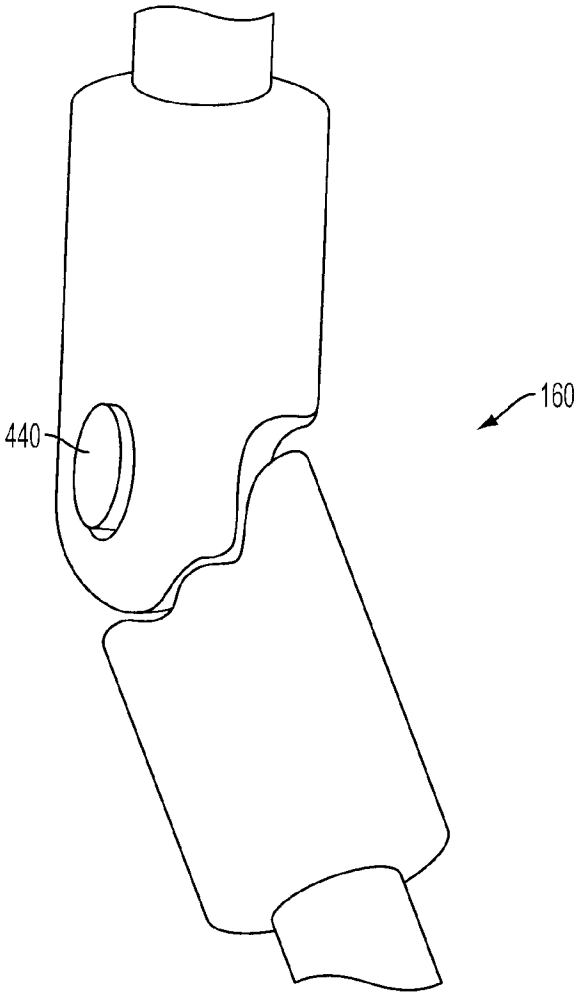
FIG. 4C is an illustrative view of a pivot joint.
Figure 4D:
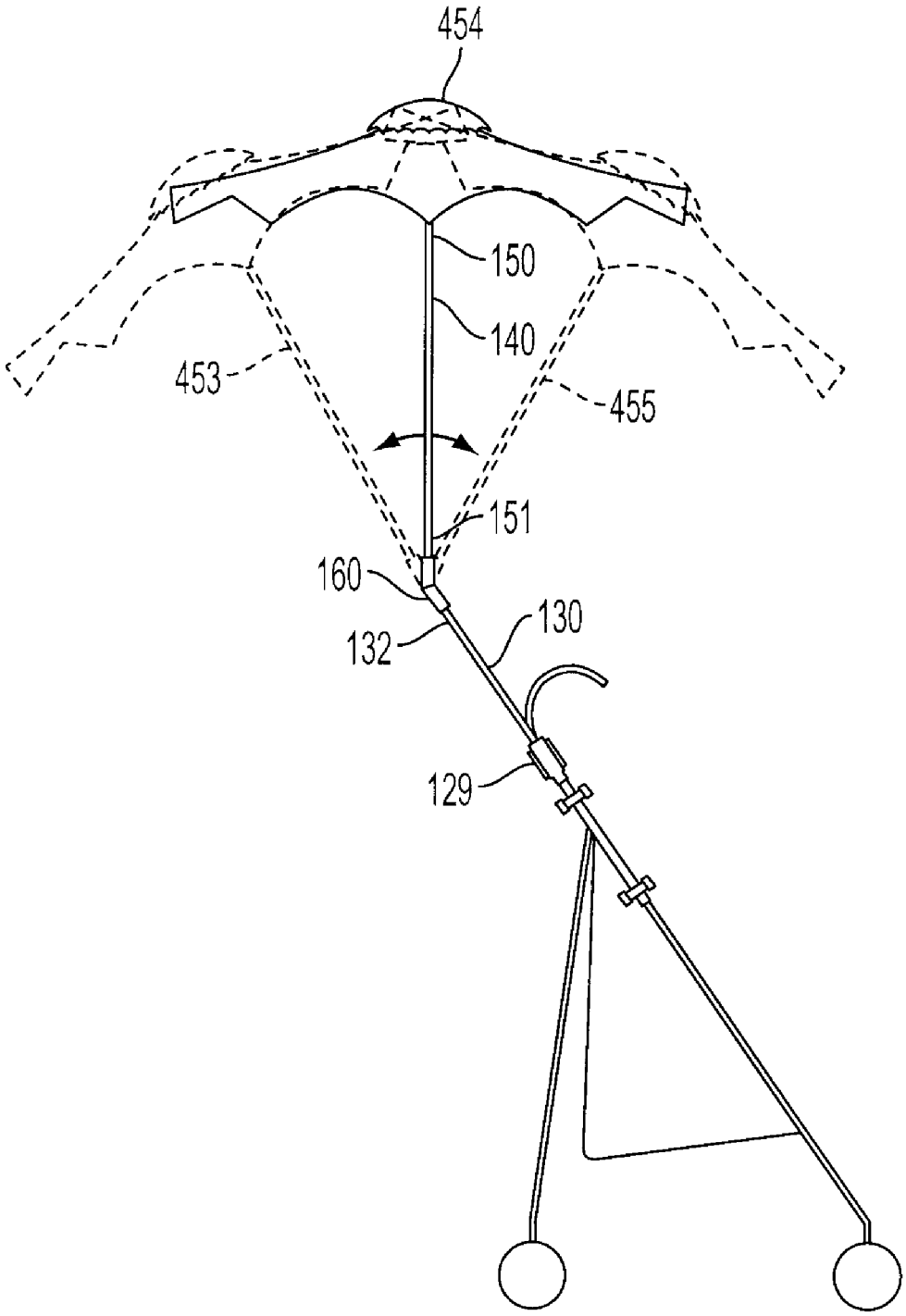
FIG. 4D is an illustrative view of an umbrella attachment device in a use position displaying various degrees of pivot.

FIG. 4D shows angular adjustment capabilities of the umbrella attachment device. The device allows for a user to pivot the umbrella 170 to a most convenient angle. A pivotal coupling device 160 connects the first 130 and second 140 sub-members of the umbrella side member 128. A pivot joint is an example of a pivotal coupling device 160 and is located in between the pivot joint end 132 of the first sub-member 130 and a pivot joint end 151 of the second sub-member 140. In one arrangement the pivotal coupling device 160 is configured to allow a change of position to one of at least three preset positions as shown in FIG. 4D. As an example, preset pivot positions 1 (453), 2 (454), and 3 (455) are shown in FIG. 4D. Each position represents a different degree of pivot with respect to the first 130 and second 140 sub-members. While three present positions are described in the depicted embodiment, it may also have two or more than three present positions.

FIGS. 4A and 4B illustrate one example of a pivot joint which includes a first disc 420 and a second disc 430. One of the discs may include holes 400 within its face and the other disc may include retractable extensions 410 which may insert into the holes 400 of the other disc. The first disc 420 can rotate relative to the second disc 430 about their common axis 431 described as a line between the two disc's centers, which are concentric. FIG. 4C shows that the pivot joint may also include a button 440. When this button is depressed, the discs can rotate as described above by allowing the retractable extensions 410 to retract. When this button is released, the retractable extensions 410 extend within the holes 400 of the first disc and the discs lock such that there is no movement between them. In an alternative embodiment, not shown, a pivot joint can include a ball and socket mechanism. Such a ball and socket mechanism allows for substantially unrestricted rotation of the first sub-member 130 with respect to the second sub-member 140, which allows pivoting over three degrees of freedom with respect to the first 130 and second 140 sub-members.

Returning to FIG. 1, an umbrella 170 is connected to the umbrella end 150 of the second sub-member 140 of the umbrella side member 128. Any desirable umbrella 170 design may be attached to the second sub-member 140. The umbrella 170 includes radial ribs 171 with a water impermeable fabric 172 stretched over each rib. The umbrella 170 shall be configured with the ability to open and close. Opening and closing the umbrella 170 may be coupled to a telescopic extension of the umbrella side member 128. Any conventional opening and closing device may be utilized.

The umbrella attachment device 103 may also include a push button mechanism for opening/closing the umbrella 170 and extending/retracting any telescopic members. When the umbrella 170 is in the use position, depressing this button, not shown, actuates collapse of the umbrella 170 and retraction of any telescopic members. When the umbrella 170 is closed and the umbrella side member 128 is collapsed, pressing the button actuates the opening of the umbrella 170 and extension of the umbrella side member 128. It is possible for closing/opening of the umbrella 170 and retraction/extension of the umbrella side member 128 to occur simultaneously, or depending on the mechanism employed, each step may proceed stepwise. The additional push button mechanism is designed to work with a mechanical and/or electrical spring loaded telescopic mechanism.

In use, when the user desires to move the umbrella attachment device 103 to a storage position, the user would close the umbrella 170, pivot the umbrella side member 128 to maximize storage potential, retract the telescopic mechanism, disconnect the removable coupling 129 from the socket end 181, and insert the umbrella side member 128 into the outer compartment 220 of the storage member 120. The storage member 120 is configured to accommodate the retracted first 130 and second 140 sub-members of the umbrella side member and the closed umbrella 170 in the outer compartment 220 after removal from the device side member 100. FIG. 5A shows an umbrella attachment device in the storage position. Storage member 120 is configured to store the closed umbrella 170 and umbrella side member 128 substantially parallel to the device side member 100 along an arm 108 of a stroller 102. Such a configuration is shown in more detail in FIG. 5B. In one example, not shown, the pivot joint 160 may be in a position that allows the first 130 and second 140 sub-members to be arranged in a side-by-side configuration. In another example, the pivot joint is arranged so that the first sub-member 130 and the second sub-member 140 are positioned essentially in a straight line with respect to one another. The latter example is shown in FIG. 4B and is particularly useful for maximizing storage space when the umbrella attachment device 103 is in the storage position.

If the user wants to later use the umbrella for covering, after it has been placed in the storage position, the user would remove the umbrella side member 128 from the outer compartment 220 of the storage member 120, attach the removable coupling 129 to the socket end 181, extend the telescopic mechanism, pivot the umbrella side member 128 to the perfect angle, and open the umbrella 170.

In one example, the umbrella attachment device 103 described herein may be constructed out of numerous materials. For example, the umbrella side member 128 and the device side member 100 may be made out of a sturdy lightweight metal such as aluminum, steel, an alloy, etc. In another example, the umbrella side member 128 and the device side member 100 may be made out of a sturdy plastic, fiberglass/composite material, etc. The storage member 120 may be made of a sturdy plastic or metal, or a combination of the two. The storage member 120 may also be made out of an elastomer or rubber compound. It is also possible for the use of other materials in the construction of the claimed device.

The device of the present invention overcomes the limitations associated with conventional umbrellas. The umbrella attachment device of the present invention provides a simple and convenient method of storing an umbrella on or within a structure and allows easy alternation from the storage position to a use position. The device is specifically designed so that a busy person can obtain outdoor protection without the need for supplemental tools and hassle.

While illustrative systems and methods as described herein embodying various aspects of the present invention are shown, it will be understood by those skilled in the art, that the invention is not limited to these embodiments. Modifications may be made by those skilled in the art, particularly in light of the foregoing teachings. For example, each of the elements of the aforementioned examples may be utilized alone or in combination or subcombination with elements of the other examples. It will also be appreciated and understood that modifications may be made without departing from the true spirit and scope of the present invention. The description is thus to be regarded as illustrative instead of restrictive on the present invention.

The invention claimed is:

1. An umbrella assembly, comprising:

a device side member including a socket end;

an umbrella side member including an umbrella end and a socket end;

an umbrella attached to the umbrella end; and a storage member which is attachable to a structure and includes an inner compartment and an outer compartment, wherein the storage member is arranged so that the inner compartment is proximal to the structure as compared to the outer compartment, which is distal to the structure, wherein the assembly allows alternation between a storage position and a use position, wherein when the umbrella assembly is in the storage position, the device side member is attached to the inner compartment; and the umbrella side member is attached to the outer compartment, wherein the socket end of the device side member and the socket end of the umbrella side member are disconnected, wherein the device side member and at least part of the umbrella side member are oriented substantially parallel to one another within the inner and outer compartments respectively, and wherein when the umbrella assembly is in the use position, the device side member is attached to the inner compartment; and the socket end of the device side member is connected to the socket end of the umbrella side member.

2. The umbrella assembly of claim 1, wherein the use position further includes the umbrella being closed or open for covering a user and wherein the storage position further includes the umbrella being closed.

3. The umbrella assembly of claim 1, wherein the umbrella side member further includes first and second sub-members, wherein the first sub-member includes a pivot joint end and the socket end and the second sub-member includes the umbrella end and a pivot joint end.

4. The umbrella assembly of claim 3, wherein at least one of the first sub-member and the second sub-member includes a telescopic mechanism.

5. The umbrella assembly of claim 4, wherein when the umbrella assembly is in the use position the telescopic mechanism is in an extended configuration.

6. The umbrella assembly of claim 3, wherein both the first and second sub-members have telescopic mechanisms.

7. The umbrella assembly of claim 4, wherein the first sub-member and the second sub-member are connected by a pivot joint at the respective pivot joint ends.

8. The umbrella assembly of claim 7, wherein the pivot joint includes at least three predetermined angular positions.

9. The umbrella assembly of claim 8, wherein the pivot joint includes two discs, wherein the two discs are configured to rotate relative to one another about a common axis.

10. The umbrella assembly of claim 8, wherein the pivot joint includes a push button.

11. The umbrella assembly of claim 1, wherein the socket end of the device side member is configured for connection and disconnection with the umbrella side member.

12. The umbrella assembly of claim 11, wherein the socket end of the umbrella side member includes a button which when depressed allows for unlocking the umbrella side member from the device side member.

13. The umbrella assembly of claim 12, further comprising a Sleeve-Lock Socket.

14. The umbrella assembly of claim 1, wherein the storage member includes at least one clamping mechanism.

15. The umbrella assembly of claim 14, wherein the at least one clamping mechanism includes adjustable wing nuts.

16. The umbrella assembly of claim 14, further including a second storage member having a second clamping mechanism.

17. The umbrella assembly of claim 16, wherein the clamping mechanisms enable the storage member to be removably coupled to the structure.

18. The umbrella assembly of claim 1, wherein the umbrella side member is attached to the device side member by a removable coupling when the umbrella assembly is in the in use position.

19. The umbrella assembly of claim 18, wherein one of the umbrella side member and the device side member includes an interfacing structure configured to enable selective locking and unlocking of the removable coupling.

* * * * *